US007134646B1

(12) United States Patent
Brooks et al.

(10) Patent No.: US 7,134,646 B1
(45) Date of Patent: Nov. 14, 2006

(54) PRIVACY FENCE SYSTEM

(76) Inventors: Roy C. Brooks, 7017 Clifton Knoll Ct., Alexandria, VA (US) 22315; Randle D. Vaughn, 1713 S. 1st St., Broken Arrow, OK (US) 74012

( * ) Notice: Subject to any disclaimer, the term of this patent is extended or adjusted under 35 U.S.C. 154(b) by 152 days.

(21) Appl. No.: 10/941,146

(22) Filed: Sep. 14, 2004

(51) Int. Cl.
*E04H 17/14* (2006.01)

(52) U.S. Cl. ..... 256/65.02; 256/21; 256/22; 256/65.11; 256/65.12

(58) Field of Classification Search ..... 256/19, 256/21, 22, 65.02, 65.1, 65.11, 65.12
See application file for complete search history.

(56) References Cited

U.S. PATENT DOCUMENTS

| | | | | |
|---|---|---|---|---|
| 917,083 | A * | 4/1909 | Kyle | 256/65.11 |
| 2,520,313 | A * | 8/1950 | Harris | 256/22 |
| 2,773,674 | A | 12/1956 | Fischer | |
| 2,919,112 | A * | 12/1959 | Cofield | 256/22 |
| 2,919,113 | A | 12/1959 | Cofield | |
| D196,840 | S | 11/1963 | Case | |
| 3,902,703 | A * | 9/1975 | Bouye | 256/65.11 |
| 3,960,367 | A * | 6/1976 | Rogers | 256/21 |
| 5,078,367 | A * | 1/1992 | Simpson et al. | 256/19 |
| 5,531,237 | A | 7/1996 | Yang | |
| 5,556,079 | A * | 9/1996 | West | 256/22 |
| 6,588,733 | B1 * | 7/2003 | Tremeer et al. | 256/65.11 |
| 6,874,767 | B1 * | 4/2005 | Gibbs | 256/65.02 |

* cited by examiner

*Primary Examiner*—Daniel P. Stodola
*Assistant Examiner*—Michael P. Ferguson

(57) ABSTRACT

A privacy fencing system may be completely roll formed out of all aluminum and other various metals. This fence bolts together entirely to simulate the traditional old wood privacy picket fence, but does not deteriorate over time as a normal wood fence. Moreover, means are provided for facilitating air to flow through the privacy fence, for adjusting the privacy fence height to non-level terrains, and for maintaining a straight line privacy fence over non-level terrains.

3 Claims, 5 Drawing Sheets

3
35

3
35

35
12

35
3

11
35
7

PRIVACY FENCE SYSTEM

FIELD OF THE INVENTION

The present invention relates generally to outdoor perimeter fencing. More particularly, the invention relates to privacy fencing that is practically maintenance free and maintains a relatively straight line even over undulating terrains.

BACKGROUND OF THE INVENTION

Many known techniques exist for constructing outdoor perimeter fencing. Several, sometimes conflicting requirements have to be met, and in some taxing applications conventional approaches have problems.

Some known fencing systems are based on tubular structures that are rust prone and tend to leave gaps in the fence line between the poles, which results in less privacy in the fence row. Typically, these designs are more focused on visual exterior appearance than durability. One problem with tubular fences is that the picket is primed of bent sheet metal to be a hollow tube with two bolts going through each often indicating that they cannot be tightened very tight or they will collapse or create a dent in the face of the picket. This tends to cause a problem if installed by a homeowner who is usually not qualified to install this kind of fence. The picket tops are usually not adjustable but will still fit the picket but could have a gap if the picket is adjusted open to its maximum diameter, whereby the fence can conform to the terrain but will not uphold the picket levelness at the top from panel to panel because of a first bracket set up on the ground pole, which is typically a strap. Moreover, when a required second bracket on the pole is placed above or below the first bracket, the next panel is made correspondingly higher or lower thereby causing the top of each panel to not be level from pole to pole.

Similarly, other approaches use preformed square tubes, which have cross rails with a notch cut into the picket side of the tube. This configuration tends to allow water to sit inside the cross rail with no way for the water to drain at least because the cross rail is mounted to the side of the ground poles. This approach may create a privacy fence but will not generally be able to conform to the terrain unless the cross rails are moved up and down on the ground pole, which creates a stair step in the fence line. Other kind of preformed square tube designs do not naturally conform with the terrain at least because all of the pickets are riveted to the cross rail in four places on each cross rail thus limiting their use to flat terrains. Moreover, complete privacy may be lost due to the use of a bracket to hold the cross rail, and because the space that tends to be between the picket and the ground pole.

Yet other conventional preformed square tubing approaches use u-bolts to hold the cross rail such that it is just sticking out and is, thereby, prone to causing injury. Similar to other versions, the channel having an open face will tends to hold water as well as dirt. Such fencing systems, likewise, will not completely conform to the terrain, thereby causing gaps at the bottom of the fence line.

Conventional approaches to privacy fencing tend to block allow airflow thereby increasing the pressure on the fence line, which tends to decreases the stability and lifespan of the privacy fencing system.

In view of the foregoing, there is a need for improved techniques for privacy fencing that are desirably essentially maintenance free, and conform with non-level terrains while maintaining a straight line.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1*c* is an exploded zoomed in view of the mounting location on cross-rails. FIG. 1*d* illustrates an end perspective view of a corner bracket according to an embodiment of the present invention. FIG. 1*e* illustrates a corner cover bracket an end perspective view of a corner bracket according to an embodiment of the present invention. FIG. 1*f* illustrates an end perspective view of a flat metal gate straps according to an embodiment of the present invention;

FIG. 2*a* illustrates an end view of ground pole. FIG. 2*b* illustrates an elevated perspective end view of the ground pole. FIG. 2*c* illustrates a front view of the exposed flat side of ground pole;

FIG. 3*a* illustrates a front view of exemplary cross rail 9. FIG. 3*b* illustrates a top view of exemplary cross rail 9. FIG. 3*c* illustrates a zoomed in view of the backside, end portion of exemplary cross rail 9. The exemplary measurements shown are in inches; FIGS. 4*a* and *c* illustrate two picket examples having an angled end, preferably having a relatively small angle. In some applications, twelve degrees is suitable. FIG. 4*b* is a side view of the example fence picket.

Unless otherwise indicated illustrations in the figures are not necessarily drawn to scale.

SUMMARY OF THE INVENTION

To achieve the forgoing and other objects and in accordance with the purpose of the invention, a variety of privacy fence construction techniques are described.

In an embodiment of the present invention, the privacy fencing system may be completely roll formed out of all aluminum and other various metals (if desired to resist the elements and maintain its superior look) with all holes and notches in each piece. This fence bolts together entirely to simulate the traditional old wood privacy picket fence, but does not deteriorate over time as a normal wood fence. Moreover, means are provided for facilitating air to flow through the privacy fence, for conforming the privacy fence height to non-level terrains, and for maintaining a strait line privacy fence over non-level terrains.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments.

Figure 1A:
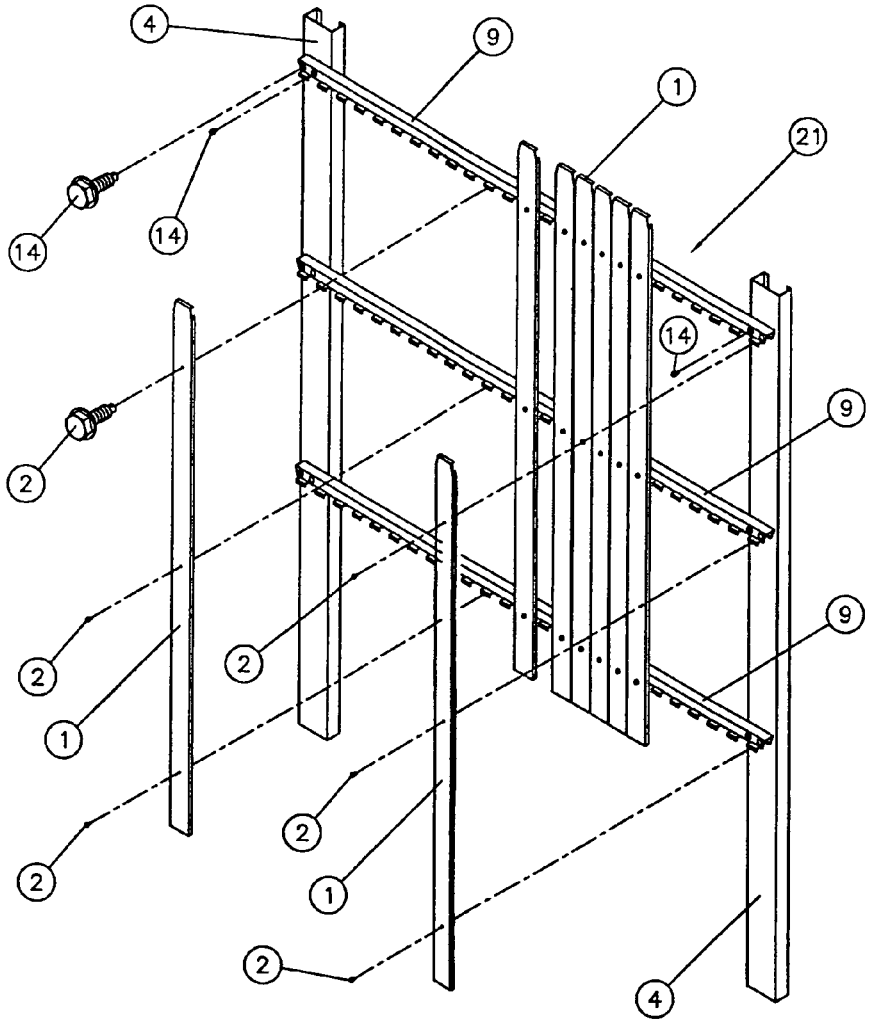
FIGS. 1*a–f* illustrates various aspects an exemplary (partially constructed) privacy fence system constructed in accordance with an embodiment of the present invention.
Figure 1B:
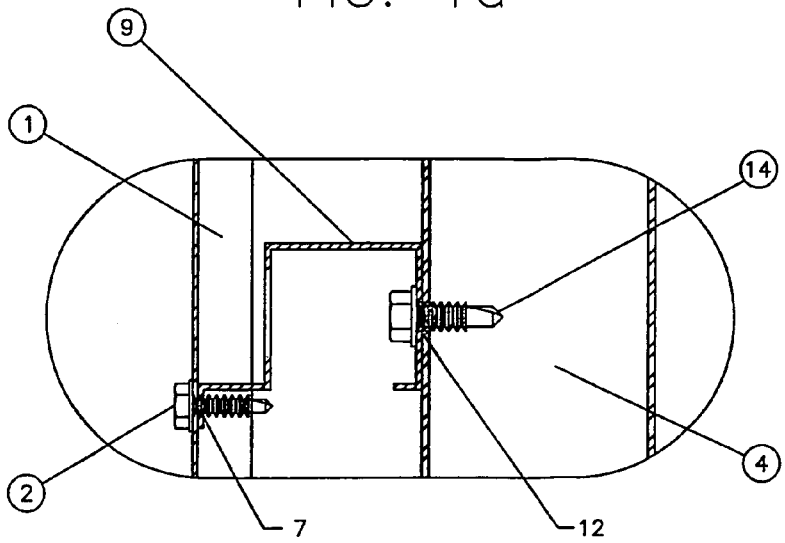
Figure 1C:
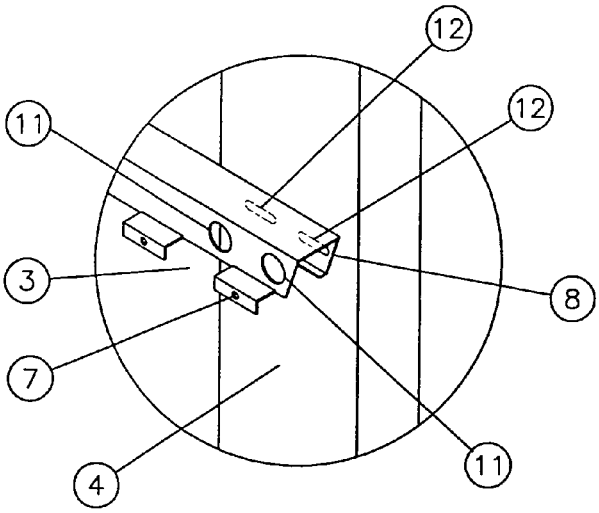
Figure 1D:
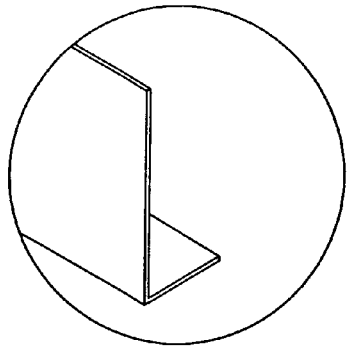
Figure 1E:
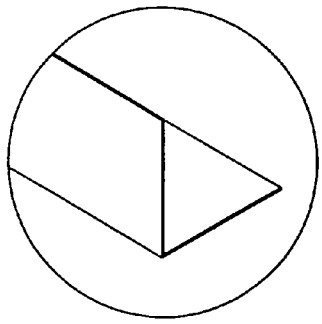
Figure 1F:
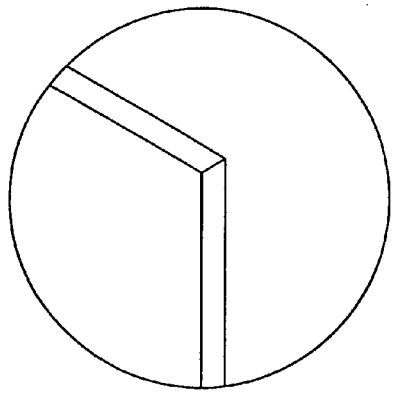

FIGS. 1*a–f* illustrates various aspects an exemplary (partially constructed) privacy fence system 21 (FIG. 1*a*) constructed in accordance with an embodiment of the present invention. Privacy fence 21 includes the basic components of the present embodiment: a ground pole 4, a cross-rail 9, a picket 1, a corner bracket cover 15 (FIG. 1*e*), a corner bracket 17, and a gate strap 19 (FIG. 1*f*). Conventional hex head washers 2 and self drilling hex head washer 14 serve to fixedly attach these components to one another, wherein each component is designed to be naturally attached to the other component to produce privacy fence 21. Ground pole 4 may be any suitable height as required by the application—a six-foot embodiment is shown in the Figure. The taller ground poles 4 are, and hence privacy fence 21, the more vertically spaced cross-rails 9 will be needed; and conversely, the shorter the fence, the fewer cross-rails 9 will be needed—by way of example and not limitation, a four foot fence might only have two levels of cross-rails 9, while a six foot fence might have two levels. Pickets 1 are preferably of the dog-ear picket type, and preferably have a similar height as ground poles 4.

FIG. 1*d* illustrates an end perspective view of a corner bracket according to an embodiment of the present invention. The corner bracket may be made of metal or other suitable materials and may be roll formed into a ninety-degree angle with offset bend dimensions. They are attached with self-tapping screws and can be used to finish off a fence line or a corner. The corner bracket is also one of the hardware components used in the construction of the gate. This corner bracket may be utilized with different size (height) pickets to construct the present privacy picket fencing system. Corner bracket 17 may be used to enhance the appearance of the inside and outside corners, and the also the end of the fence line. Corner bracket 17 is also used in conjunction with corner bracket cover 15, which is assembled around privacy fence system 21 with self-drilling hex head washer screws, for example, to create the gate. Corner bracket 17 is useful to add a more enhanced appearance to the fence.

FIG. 1*e* illustrates an end perspective view of a corner cover bracket according to an embodiment of the present invention. The corner cover bracket may be made of metal or other suitable materials and may be roll formed into a ninety-degree angle with a centerline bend dimension. It is attached with self-tapping screws and can be used to finish off a fence line or a corner. The corner cover bracket is also one of the hardware components used in the construction of the gate. This corner cover bracket may be utilized with different size (i.e., height) pickets to construct the present privacy picket fencing system. Corner bracket cover 15 is used to enhance the appearance of the inside and outside corners, and the end of the fence line. This 15 six-foot corner bracket cover is also used in conjunction with the corner bracket 17 that is assembled around the privacy fence system 21 with self-drilling hex head washer screw to create the gate. This corner bracket cover 15 is useful to add a more enhanced appearance to the present privacy fence. The length of corner bracket cover 15 depends on the application, but in many applications is the same as the height of privacy fence.

FIG. 1*f* illustrates an end perspective view of a flat metal gate straps according to an embodiment of the present invention. The flat metal gate straps are used to support the weight of the gate once positioned in the desired location and secured with the self-drilling hex-head washer screws. Gate strap 19 is used once the gate is assembled. Gate strap 19 may be used to hold the gate in its appropriate location once the self-drilling hex head washer screw is installed. Gate strap 19 is used on privacy fence system 21 after being cut to the desired length.

The self-drilling hex-head washer screws are standard made galvanized or stainless steel. The 6–20×½ self-drilling hex-head washer screw is used to attach the cross rails, corner brackets and corner cover brackets to the ground pole. The ¼–14×¾ self-drilling hex-head washer screw is used to attach the pickets to the cross rails.

Privacy fence 21 is assembled between two six-foot ground poles 4 that are preferably positioned in the ground using concrete for ground support at the required distance between each for panel assembly. Three cross-rails 9 are then attached to ground poles 4 in three locations on the flat side according to known means, such as, for example, with two self drilling hex head washer screws that go through a cross-rail mounting hole 11 and into a ground pole mounting slot 12. In the present embodiment, two such mounting holes are provided for solid support; however, alternative embodiments, instead, may only have one set of mounting holes, or more sets of mounting holes if stronger support is required by the application.

FIG. 1*c* is an exploded zoomed in view of the mounting location on cross-rails 9, wherein Pickets 1 are then placed between notches 3 adjacent to each other to create a privacy fence suitable to provide as small as a with one-eighth gap between pickets 1, which permits movement in the fence to assist the fence in conforming to terrain changes. Pickets 1 are bolted onto the face of cross-rails 9, preferably with three self-drilling hex head washer screws for locking pickets 1 into picket mounting holes 7 on the outer edge of cross-rail 9. Depending on the particular application, any suitable mounting means may be incorporated as part of cross-rails 9 to effectively mount pickets 1 thereon.

Those skilled in the art will appreciate that the foregoing design allows for movement in the fence as the terrain changes in height. Panels, or relatively small sections of fence, can also be partially assembled and then placed at the appropriate location on ground poles 4 and bolted on. The panels are then finished with pickets 1 by mounting them adjacent to one another until privacy is achieved and secured with self drilling hex head screws.

Gates may be constructed by cutting down the privacy picket fence panel to the desired width and by using corner bracket covers 15 and corner bracket 17 to create an outer frame for the gate—standard hinges may be used to hang the gate. Once the gate is hung, make necessary adjustments and then strap from the top hinge side down to the opposite lower bottom side using gate strap 19 after cutting it to a desired length. Privacy fence system 21 may be constructed entirely out of aluminum or other suitable metals may be used. A wrinkle powder coating may be applied to achieve an aesthetically pleasing finish. The powder coating finish or paint finish may be used as the final finish on all components utilized in the construction of the present privacy picket fence.

Figure 2B:
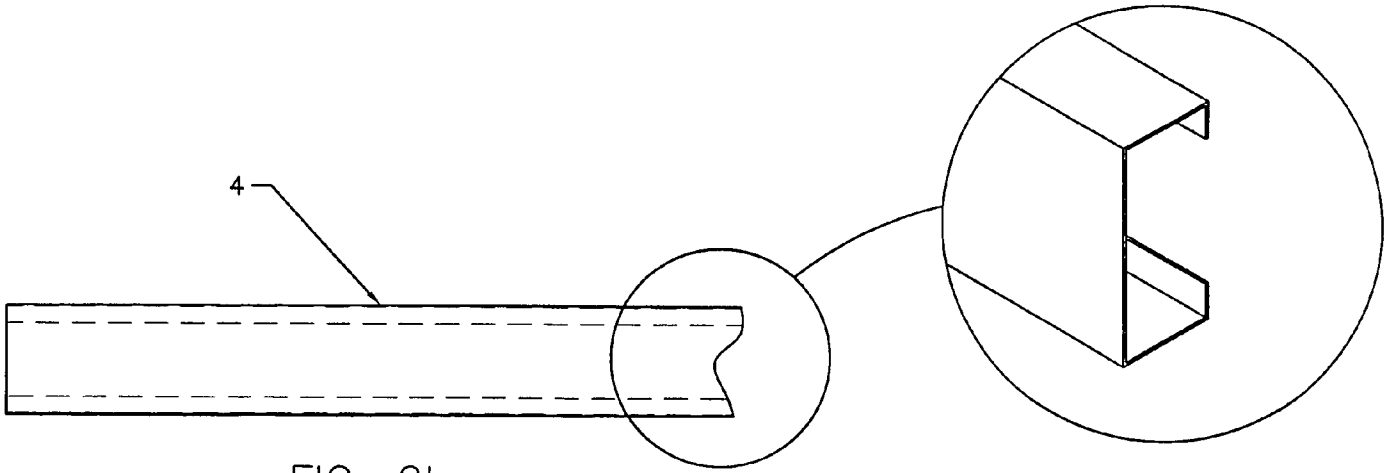
FIGS. 2*a–c* illustrates various views and dimensions of an exemplary 6 foot ground pole that may be used as structure support to secure the privacy fence of FIG. 1*a* to the ground in accordance with an embodiment of the present invention. The exemplary measurements shown are in inches.
Figure 2C:
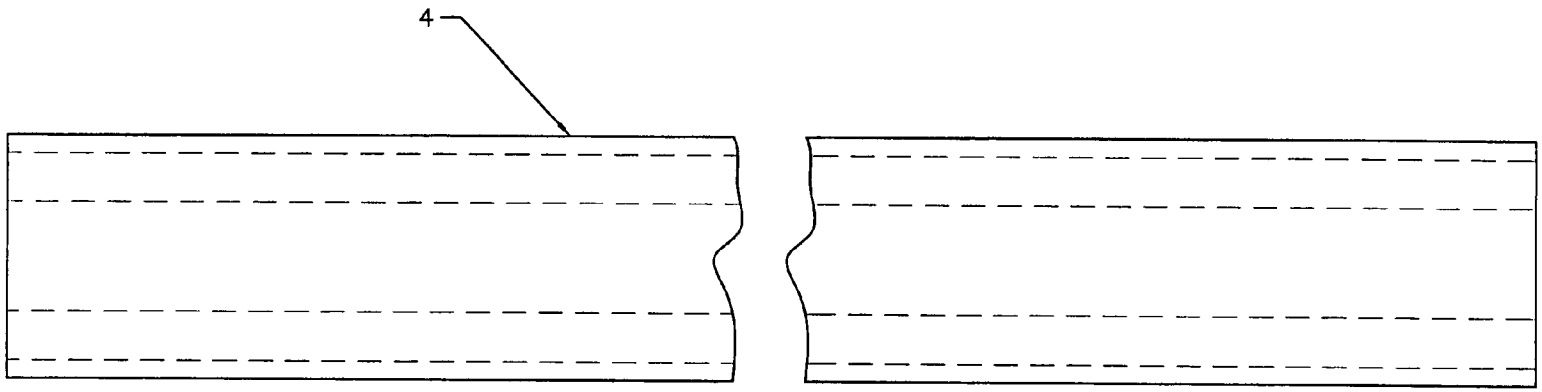
Figure 2A:
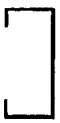

FIGS. 2*a–c* illustrates various views and dimensions of an exemplary 6 foot ground pole 4 that may be used as structure support to secure the privacy fence of FIG. 1 to the ground in accordance with an embodiment of the present invention. The exemplary measurements shown are in inches. FIG. 2*a* illustrates an end view of ground pole 4. FIG. 2*b* illustrates an elevated perspective end view of the ground pole 4. FIG. 2*c* illustrates a front view of the exposed flat side of ground pole 4. Of course, those skilled in the art will recognize that any suitable dimensions and alternative configurations for ground pole 4 will work.

Ground pole 4 is typically set in concrete at the desired depth and the required width. The ground poles span the terrain and are preferably laid out to maintain the vertical positions so that when the cross-rails are mounted thereon, the ground poles will be in the required location depending of the length of the cross-rails. That is, the ground poles are placed as needed to connect the cross-rail. The ground poles position and orientation should preferably vary from left to right at a minimum so that the fence line stays straight. The ground poles may be roll formed into a C-channel shape, as shown in the Figure, if so desired.

Figures 3A, 3B, 3C, 3D, 3E, 3F:
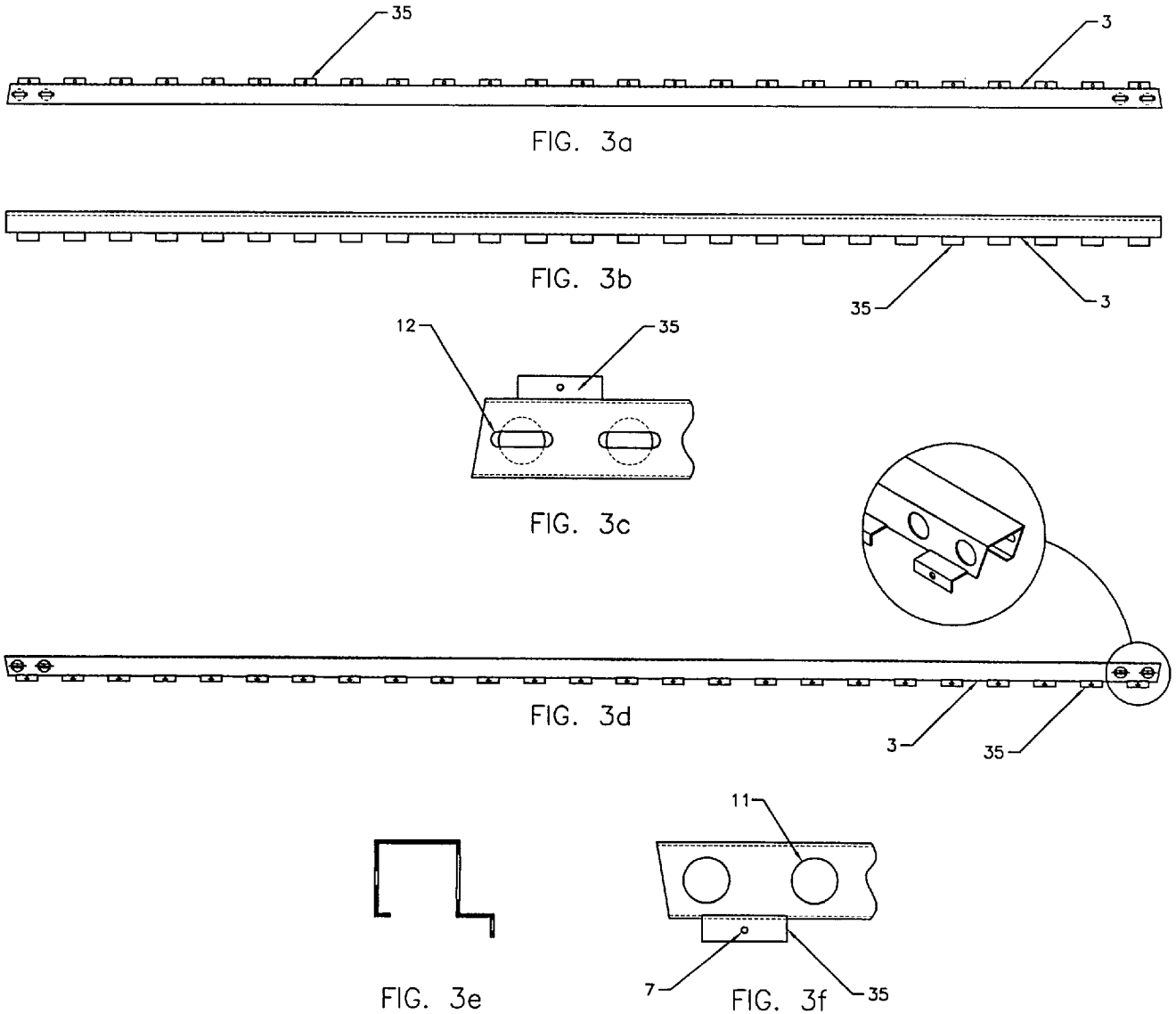
FIGS. 3*a–f* illustrates various views of an exemplary cross rail 9 that is used to support a picket and maintain the layout for the privacy fence of FIG. 1 in accordance with an embodiment of the present invention.

FIGS. 3*a–f* illustrates various views of an exemplary cross rail 9 that is used to support a picket and maintain the layout for the privacy fence of FIG. 1 in accordance with an embodiment of the present invention. FIG. 3*a* illustrates a front view of exemplary cross rail 9. FIG. 3*b* illustrates a top view of exemplary cross rail 9. FIG. 3*c* illustrates a zoomed in view of the backside, end portion of exemplary cross rail 9. The exemplary measurements shown are in inches. Of course, those skilled in the art will recognize that any suitable dimensions and alternative configurations for cross rail 9 will work.

Cross-rail 9 has a length that is suitable for the particular application, which for a typical application might be about six feet three inches long. The embodiment shown in the backside detailed view of FIG. 3*c* shows two ground pole mounting slot 12. The embodiment shown in the detailed view of FIGS. 3*d* and *e* show, cross-rail mounting holes 11 in the front view on each end of the cross-rail 9 which are useful to access to ground pole mounting slots 12. That is, ground pole mounting slots 12 receive self-drilling hex head washer screw 14 through cross-rail mounting holes 11 (see FIG. 1*b*). The cross-rail 9 is mounted in the center of the ground pole 4 for the purpose of mounting the next cross-rail 9 adjacent to it. The cross-rail 9 also preferably has a slight angle (e.g., a ten-degree angle in some applications) (see FIG. 1*c* element 8) on each end for the purpose of making suitable adjustments to cross-rail 9 to conform with the terrain. In one implementation of cross-rail 9, there are cross-rail lips 35 (twenty-five for example) that are spaced equally across the front, which primarily serve a first purpose being that cross-rail lips 35 support pickets 1 from rubbing on cross-rails 9 (see FIG. 1*b* for a detailed view); and, a second purpose being that cross-rail lips 35 have a pre-punched hole 7 (see FIG. 3*e*) for location on pickets 1 to maintain the proper picket spacing on the panel and when the next adjacent panel begins. Also, notches 3 enable picket 1 to set back into cross-rail 9. This process insures proper location for each picket once placed on the fence line. Pickets generally come in a multiplicity of desired lengths to create various heights for the present privacy fence system.

Figure 4A:
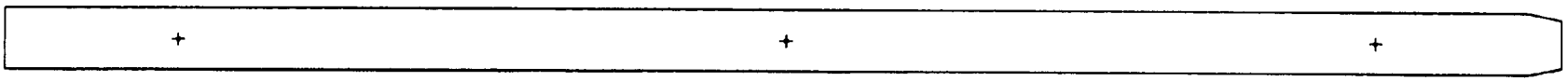
FIGS. 4*a–c* illustrates various views of an exemplary dog-ear picket that may be used in the construction of the privacy fence of FIG. 1 in accordance with an embodiment of the present invention.
Figure 4B:
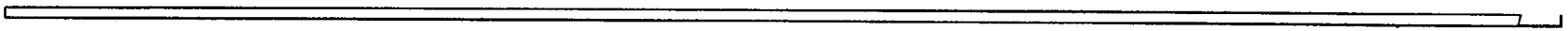
Figure 4C:
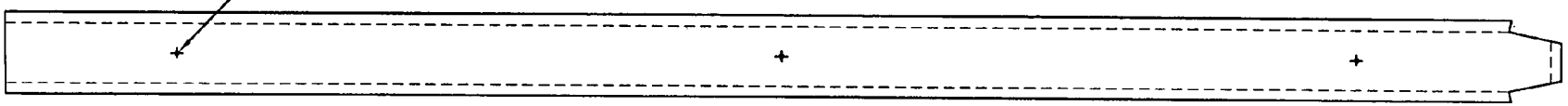

FIGS. 4*a–c* illustrates various views of an exemplary fence picket in accordance with an embodiment of the present invention. In the Figure is shown an exemplary six-foot picket 1 of the dog-ear type, which is made to resemble the old traditional wood picket with a dog-ear at the top. All measurements are by way of example, and not limitation. Those skilled in the art will readily know how to adapt the configuration of picket 1 to the requirements of the particular application.

FIGS. 4*a* and *c* illustrates two picket examples having an angled end, preferably having a relatively small angle. In some applications, twelve degrees is suitable. FIG. 4*b* is a side view of the example fence picket. For the six-foot example shown in the Figure, a dog-ear picket is rolled formed out to have a half-inch bend on three sides to give the picket a thick look, that resembles the thickness of the old wood fence, with three picket locating holes 45 in the face of each dog-ear picket which take a self drilling hex head washer screw through each picket hole 45, thereby attaching picket 1 to cross-rail 9, and in turn being attached to the ground pole 4 (see again FIG. 1*b*). The picket 1 is formed so that when assembled onto the cross-rail 9 adjacent to one another there is about one-eighth inch gap between each picket 1. This gap serves at least two purposes: The first purpose is that the gap allows the fence to move up and down the terrain and still maintain its vertical position. The second purpose is when the wind blows the gap allows the wind to penetrate the fence to relieve the pressure that is being pushed against the fence. In dog-ear embodiments, for example, picket 1 brings an aesthetic appeal to the resulting fencerow and conveys the old traditional wood picket fence look.

The foregoing embodiments provide a secure privacy fence that is aesthetically pleasing, may be made of various materials that can be powder coated with a wrinkle powder effect, thereby presenting a semi-gloss look with a texture feel. Those skilled in the art will appreciated the privacy fence of the present invention may be designed to be fireproof and created from recycled materials; and, hence, is environmentally safe and conserves natural wood resources. Moreover, the privacy fence of the present invention can be relatively easily detached at anytime by simply unbolting it.

Having fully described at least one embodiment of the present invention, other equivalent or alternative methods of constructing privacy fence system according to the present invention will be apparent to those skilled in the art. The invention has been described above by way of illustration, and the specific embodiments disclosed are not intended to limit the invention to the particular forms disclosed. The invention is thus to cover all modifications, equivalents, and alternatives falling within the spirit and scope of the following claims.

What is claimed is:

1. A privacy fence system comprising:

a plurality of ground poles providing vertical structural support into the ground;

at least one cross-rail providing horizontal structural support;

a plurality of cross-rail mounting holes in each end of each said cross-rail for mounting said cross-rail upon said ground poles; whereby said cross-rail is mounted upon said ground poles using fasteners extending through cross-rail mounting holes;

a plurality of pickets substantially blocking visibility, said pickets having upper and lower ends; and a plurality of cross-rail lips protruding perpendicularly from each said cross-rail for mounting said pickets upon said cross-rail; whereby each said picket is mounted upon said cross-rail using a fastener extending through a mounting hole in a corresponding cross-rail lip; said cross-rail lips being unitarily formed as a single piece with said cross-rail and defining a plurality of notches between said cross-rail lips for receiving said pickets, said cross-rail lips being spaced uniformly along the length of said cross-rail;

wherein, when said pickets are mounted upon said cross-rail lips, a plurality of gaps are defined between adjacent pickets; said gaps permitting angular movement of said pickets within said notches, enabling said upper ends of said pickets to maintain a straight line fence height over non-level terrains, and said gaps facilitating air to flow between said pickets.

2. The privacy fence system of claim 1 further comprising means for simulating the surface appearance of wood.

3. The privacy fence system of claim 1 further comprising means for providing a semi-gloss appearance having a surface texture.

* * * * *

UNITED STATES PATENT AND TRADEMARK OFFICE

CERTIFICATE OF CORRECTION

PATENT NO. : 7,134,646 B1
APPLICATION NO. : 10/941146
DATED : November 14, 2006
INVENTOR(S) : Roy C. Brooks et al.

It is certified that error appears in the above-identified patent and that said Letters Patent is hereby corrected as shown below:

Title page, item [76] second inventor should read -- Randall D. Vaughn --

Signed and Sealed this

Thirtieth Day of January, 2007

JON W. DUDAS
*Director of the United States Patent and Trademark Office*